US009127378B2

(12) United States Patent
Schneider et al.

(10) Patent No.: US 9,127,378 B2
(45) Date of Patent: Sep. 8, 2015

(54) SPINNING MACHINE COMPRISING A COMPACTION DEVICE

(75) Inventors: Gabriel Schneider, Winterthur (CH); Ludek Malina, Kloten (CH); Radek Zarecky, Ceska Trebova (CZ); Petr Blazek, Chocen (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 272 days.

(21) Appl. No.: 13/989,613

(22) PCT Filed: Nov. 23, 2011

(86) PCT No.: PCT/CH2011/000280

§ 371 (c)(1), (2), (4) Date: May 24, 2013

(87) PCT Pub. No.: WO2012/068693

PCT Pub. Date: May 31, 2012

(65) Prior Publication Data

US 2013/0239369 A1 Sep. 19, 2013

(30) Foreign Application Priority Data

Nov. 26, 2010 (CH) ..... 1992/10

(51) Int. Cl.
*D01H 5/72* (2006.01)

(52) U.S. Cl.
CPC ..... *D01H 5/72* (2013.01)

(58) Field of Classification Search
CPC ..... D01H 5/56; D01H 5/72
USPC ..... 57/315; 19/236
See application file for complete search history.

(56) References Cited

U.S. PATENT DOCUMENTS 6,032,451 A * 3/2000 Dinkelmann et al. ..... 57/315
6,131,382 A * 10/2000 Dinkelmann et al. ..... 57/315
CN 2851298 12/2006
CN 101613896 12/2009

(Continued)

FOREIGN PATENT DOCUMENTS

CN 2585874 11/2003
CN 1712588 12/2005

(Continued)

OTHER PUBLICATIONS

Search Report, Feb. 17, 2011.

*Primary Examiner* — Shaun R Hurley
(74) *Attorney, Agent, or Firm* — Dority & Manning, P.A.

(57) ABSTRACT

The invention relates to a device for compacting a sliver (V) on a spinning machine. At least one rotatably supported nip roller (33) is associated with a compaction element downstream from a suction zone (Z) to form a nip line (P). The compaction element (17) and the nip roller (33) are rotatably supported on a shared support (20) that is detachably fastened to the spinning machine via fastening means (46). The compaction element (17) has at least one drive element (28) that forms a drive connection with a bottom roller (7) of a pair of delivery rollers (7, 8) via a weighting device (55, 58) when the compaction element is transferred from an idle position to an operating position. The support has a suction channel (SK) for the suction air of the compaction element (17). A first end (S1) of the suction channel (SK) is connected to the compaction element, and a second end (S2) of the suction channel (SK) ends in the area of the support (20), by means of which the support in its installed position is fastened to the spinning machine.

18 Claims, 4 Drawing Sheets

(56) References Cited

U.S. PATENT DOCUMENTS

| | | | | |
|---|---|---|---|---|
| 6,131,383 | A * | 10/2000 | Dinkelmann et al. | 57/315 |
| 6,134,872 | A * | 10/2000 | Olbrich | 57/264 |
| 6,189,308 | B1 * | 2/2001 | Dinkelmann et al. | 57/76 |
| 6,202,398 | B1 * | 3/2001 | Dinkelmann et al. | 57/76 |
| 6,209,300 | B1 * | 4/2001 | Stahlecker | 57/264 |
| 6,332,244 | B1 | 12/2001 | Camozzi | |
| 2002/0134068 | A1 * | 9/2002 | Gnos et al. | 57/315 |
| 2014/0157749 | A1 * | 6/2014 | Schneider et al. | 57/315 |
| 2015/0027098 | A1 * | 1/2015 | Nageli et al. | 57/315 |

FOREIGN PATENT DOCUMENTS

| | | | |
|---|---|---|---|
| DE | 198 46 268 | | 10/1999 |
| DE | 199 32 099 | A1 | 1/2001 |
| DE | 100 18 480 | | 10/2001 |
| DE | 100 50 089 | A1 | 10/2001 |
| DE | 100 41 363 | A1 | 3/2002 |
| DE | 101 58 001 | A1 | 6/2003 |
| DE | 102 27 463 | | 10/2003 |
| DE | 10 2005 010 903 | | 9/2005 |
| EP | 0 947 614 | | 5/2004 |
| EP | 1 612 309 | | 9/2009 |

* cited by examiner

SPINNING MACHINE COMPRISING A COMPACTION DEVICE

FIELD OF THE INVENTION

The invention relates to a device for compacting a sliver on a spinning machine, the sliver being delivered by a pair of delivery rollers of a drafting system unit to a suctioned guide surface of a suction zone of a subsequent driven, revolving compaction element that is acted on by suction air. At least one rotatably supported nip roller is associated with the compaction element downstream from the suction zone to form a nip line.

BACKGROUND

Numerous designs are already known in practice, wherein for compacting the fiber material (fiber strand) discharged by a drafting system unit, a compaction unit is situated downstream. Following such a compaction unit, the compacted fiber material, after passing through a nip point, is fed to a twist generation device. Such a twist generation device in a ring spinning machine, for example, is composed of a traveler that revolves on a ring, and the yarn produced is wound onto a rotating bobbin. Suctioned revolving, perforated suction drums or revolving aprons provided with perforations are essentially used as compaction units. A specialized suction area on the compaction element is thus defined by using appropriate inserts inside the suction drum or inside the revolving apron. These types of inserts may be provided, for example, with appropriately shaped suction slits to which a negative pressure is applied, thus generating a corresponding air flow at the periphery of the particular compaction element. In particular, protruding fibers are incorporated as a result of this air flow which is oriented essentially transversely with respect to the direction of transport.

In the known approaches, the fiber material delivered by the drafting system unit is guided above or also below the compaction devices. In particular for use on a ring spinning machine, it is necessary to provide an additional nip point downstream from the suction zone in order to get a twist stop.

These types of devices have been illustrated and described in the publications EP 947 614 B1, DE 10 2005 010 903 A1, DE 198 46 268 C2, EP 1 612 309 B1, DE 100 18 480 A1, and CN 1712588 A, for example. These cited publications essentially involve fixedly mounted compaction units that are installed following the particular drafting system. The drive of these compaction units is sometimes achieved via specialized drive shafts that are situated over the length of the spinning machine and are in drive connection with either a suction roller or a revolving apron, or via a fixedly installed drive connection to appropriately situated pressure rollers of the compaction device. Likewise, examples of drives are found in the exemplary embodiments of the cited publications, wherein the drive of the compaction unit is achieved via additional drive elements of the top and bottom rollers of the pair of delivery rollers of the drafting system unit. In practice, it is necessary to retrofit existing spinning machines with a conventional drafting system unit having such a compaction device in order to also ensure the possibility of producing high-quality yarns. Therefore, devices have been proposed by means of which conventional drafting systems may be retrofitted with such a compaction device. One such example is found in DE 102 27 463 C1, for example, in which the punch of the drafting system unit is extended in order to support an additional drive roller provided for the drive of the retrofitted compaction device that is likewise situated on this extension.

The drive roller extends over the entire length of the spinning machine. The mounting and installation of such a retrofit unit is very time-consuming and inflexible. That is, a desired dismantling to a standard drafting system without a compaction device is in turn very time-consuming.

A design is known from CN 101613896 A in which an additional element is screwed to the punch for extending the punch of the drafting system. Also described in this exemplary embodiment, is a gearing stage having gear pairs via which the drive of an additional compaction device is to be achieved. This device is also relatively time-consuming for the retrofitted attachment, in particular also due to the additional installation of the disclosed gearing stage.

In addition, a design having a compaction device is disclosed in DE 100 50 089 C2, which is provided for retrofitting of a conventional drafting system unit. A device is proposed that allows the drafting system unit to be retrofitted with a compaction device without additional drive members. Different designs of compaction devices are disclosed in the exemplary embodiments of the cited publication. In all the disclosed devices, a second nip point for the fiber material is formed by the compaction device itself or via drive elements that are connected to the compaction device. The compaction device or drive elements connected thereto rest(s) on the top roller of the pair of delivery rollers of the drafting system unit. That is, in this case no additional nip point is provided on the compaction device, which is formed independently from the rollers of the drafting system unit. Thus, the fiber material delivered from the nip point of the delivery rollers of the drafting system unit does not make contact in the area of the suction zone, which is located in front of the second nip point. That is, most of the fiber material delivered by the drafting system unit moves at a distance from the surface of the compaction device in the area of the suction zone. Thus, controlled compaction or incorporation of protruding fibers is not ensured. Furthermore, the cited publication does not address how the additionally installed compaction device is mounted on the spinning machine or on the drafting system unit.

A device is known from CN 2 851 298 Y in which a compaction roller together with a twist stop roller are accommodated in a bearing element that is connected by means of a plate to a pivotable weighting arm of a drafting system device via screws. In the installed and locked position, the drive is transmitted via friction from a delivery roller connected directly to a drive and its associated pressure roller to the compaction roller and the twist stop roller. The compaction device disclosed here is likewise provided for retrofitting on existing drafting system units of spinning machines without compaction. The mounting of the compaction unit disclosed here on an existing drafting system unit via a screw connection, as well as the threading for the axle of the pressure roller, is relatively time-consuming, and requires additional adjustment of the distances. Likewise, the connection to a negative pressure source must also be established separately. Since the compaction roller is driven only indirectly via friction by a roller directly connected to a drive, drive losses result in this approach.

SUMMARY OF THE INVENTION

An object of the invention, therefore, is to propose a compaction device which may be easily and quickly installed on conventional drafting system units without the need for additional drive elements. The aim is to avoid the disadvantages of known designs, ensuring simple and quick assembly and disassembly of a compaction device. Objects and advantages of the invention are set forth in part in the following description, or may be obvious from the description, or may be learned through practice of the invention.

In accordance with aspects of the invention, it is proposed that the compaction element and the nip roller are rotatably supported on a shared support that is detachably fastened to the spinning machine via fastening means, and the revolving compaction element, which is provided with openings, has at least one drive element that forms a drive connection with the bottom roller of the pair of delivery rollers via a weighting device when the compaction element is transferred from an idle position to an operating position. The support has a suction channel for the suction air of the compaction element, and a first end of the suction channel is connected to the compaction element. A second end of the suction channel ends in the area of the support, by means of which the support in its installed position is fastened to the spinning machine. It is thus possible to design the additional compaction device as a complete replacement module that, for attachment to a conventional drafting system, may be easily and quickly mounted on existing devices. No additional drive devices are necessary, since the drive of the compaction element is accepted directly from one of the rollers of the pair of delivery rollers of the drafting system unit. In this regard, a connection may be provided by means of friction, or by a connection via a positive fit (gear pairs).

The compaction element and the drive element may be adjacently located on a shared rotational axis.

It is preferably further proposed that the second end of the suction channel ends in the area of a contact surface of the support, via which the support in the mounted, installed position rests against an element of the spinning machine. As a result of the proposed integration of a suction channel inside the support, additional cabling is avoided in part, and on the other hand, a compact, closed design is obtained that allows connection of the suction channel to existing elements of the spinning machine.

Furthermore, it is proposed that the element of the spinning machine to which the support is fastened is a channel that is fastened to the spinning machine and is connected to a negative pressure source and provided with openings situated in the area of the fastening point of the particular support. By means of this proposal, it is possible at the same time for the suction channel situated in the support to be connected to the negative pressure source when the support is fastened to the channel.

To completely seal off this connection from the ambient air, it is proposed that the end of the suction channel of the support facing the channel is provided with elastic sealing elements placed around the opening in the suction channel, whereby in the installed location of the particular support in the operating position, the opening in the suction channel and the respective opening in the channel of the spinning machine are opposite one another, and the sealing elements rest in a sealing manner on the channel.

It is also possible to provide exchangeable inserts in the area of the opening in the suction channel of the support that is opposite from the channel of the spinning machine. By use of these inserts, the cross section of the opening may be adapted to ensure that the same pressure conditions prevail at all compaction modules used on the spinning machine. That is, a corresponding insert may be provided, depending on the distance from the negative pressure source where the compaction module is mounted on the spinning machine. DE 100 41 363 A1 describes a device in which the suction lines for each spinning station are appropriately designed for adapting the pressure conditions. However, permanently installed compaction devices are disclosed.

Furthermore, it is proposed that the channel has a circular cross section, and the support is provided with a U-shaped end piece that is open on one side, by means of which the inner surface of the support in the installed position rests on the circular channel and partially encloses same. The U-shaped end piece is used as a fastening means via which the support is mounted on the spinning machine. The depression is U-shaped, with the opening of the U-shaped end piece pointing in the direction of the spinning machine when installed. For mounting the compaction module, it is thus possible to simply place the support on the circular channel. The dimensions of the U-shaped end piece (in particular its clearance) are to be selected in such a way that a sufficient clamping force is present between the circular channel and the U-shaped end piece of the support. To further increase the clamping effect, it is conceivable to form the circumferential angle of the inner surface of the end piece in the area of the contact surface to be slightly greater than 180 degrees. In this case, the support in the area of the end piece should have an elastic design, at least in portions, so that elastic yielding of the elastic U-shaped legs of the end piece motion is possible. This combination, in which the inner surface of the U-shaped end piece rests on a partial area of the outer periphery of the circular channel, allows the support together with the compaction device (as a complete compaction module) to be swiveled around the center axis of the circular channel. This makes it possible for the compaction device to be swiveled away from the area of the pair of delivery rollers of the drafting system unit without having to remove the support from the channel. The swivel motion may, as is generally known, be limited by appropriate stops.

To achieve a different peripheral speed between the pair of delivery rollers of the drafting system unit and the revolving compaction element, it is further proposed that a gearing stage is provided between the drive element and the revolving element. It has been shown in practice that it is advantageous, in particular when angled suction slits are used, for the peripheral speed of the compaction element to be slightly less than the peripheral speed of the pair of delivery rollers. This is due to the longer path that the fiber material must travel in the area of the suction zone.

It is preferably proposed that the drive element is designed as a friction wheel that in the working position is held in contact with the bottom roller of the pair of delivery rollers by frictional locking via a weighting device.

The revolving compaction element may be formed from a suction drum.

It is proposed that the suction drum has bearing elements by means of which the suction drum is rotatably supported on a shaft that is fastened to the support, and is fixable on the shaft in the axial direction via securing means mounted on the shaft. Simple and quick disassembly and assembly of the suction drums on the shaft that is fastened to the support is thus made possible.

The nip roller may preferably be mounted beneath the suction drum, following the suction zone. That is, the fiber material delivered by the pair of delivery rollers of the drafting system unit is deflected downwardly and is guided in a suction zone on the suction drum before it reaches the area of the nip point having the nip roller.

It is further proposed that the friction wheel is designed as a symmetrical ring which with its circular inner surface rests on a partial area of the peripheral surface of a circular projection that is connected in an axially parallel manner to the suction drum. The clearance of the friction wheel is larger than the outer diameter of the projection. This design results in an advantageous approach that is encapsulated against dust influences. In addition, this type of gearing stage requires little power, and is quiet, in particular when the ring-shaped friction wheel is made of an elastic material (rubber, for example). The ring-shaped dimensions of the friction wheel are selected in such a way that in the operating position, the friction wheel is in frictional contact with one of the driven rollers of the pair of delivery rollers, and the peripheral surface of the suction drum has a certain distance to the roller that is in drive contact with the friction wheel.

Furthermore, it is proposed that the suction channel is connected to at least one suction tube for thread suction. It is thus possible to combine the thread suction in the event of a thread break with the suction for the area of the suction zone, and to integrate same into the module of the compaction device. The opening in the suction channel, as is generally known, is located following the nip point between the compaction element and the associated nip roller.

Furthermore, it is proposed that the nip roller is fastened to the support via a spring element that carries a bearing receptacle for the rotational axis of the nip roller and generates a clamping force on the compaction element in the area of the nip line. The weighting device for the pressure roller is thus integrated directly on the module of the compaction device, so that any necessary adjustments of the clamping force or of the nip line may be made before installation on the spinning machine.

It is advantageous if the support is pivotably fastened to the spinning machine transversely with respect to the rotational axes of the pair of delivery rollers, and holding means are provided on the spinning machine that protrude into the swivel area of elements fastened to the support and limit the swivel motion of the support, at least in one swivel direction. It is thus possible on the one hand to lock the compaction element, including its pressure roller, in its working position, and on the other hand, to swivel the compaction element into an idle position in order to perform necessary maintenance operations. In addition, it is advantageous if, as further proposed, the retaining elements are composed of spring elements that are fastened to the spinning machine, via which, in a locking position with the elements of the support designed as locking bars, the drive wheel is held in a frictional locking connection with one of the rollers of the pair of delivery rollers. In this way, two functions may be combined with one another at the same time. On the one hand, the compaction module is held in a working position, and on the other hand a corresponding pressure force is applied to the friction wheel in order to generate frictional locking with the correspondingly driven roller of the pair of delivery rollers. Two such spring elements are generally provided for a compaction module, in each case a spring element being situated to the side of the support.

Furthermore, it is proposed that the drafting system unit is designed as a twin drafting system having two adjacently situated drafting systems having a shared weighting arm, and the compaction elements together with a nip roller associated in each case with the pairs of delivery rollers are rotatably supported on a shared support, and the support is provided with a shared suction channel which is connected to the compaction elements. These types of twin drafting systems are fairly common. By use of the proposed design, a simple and compact approach is obtained by means of which in particular retrofitting and equipping a spinning machine with these types of compaction devices may be carried out quickly and easily.

The device is preferably used on a spinning machine.

Further advantages of the invention are shown and described in greater detail with reference to the following exemplary embodiments.

DETAILED DESCRIPTION

Figure 1:
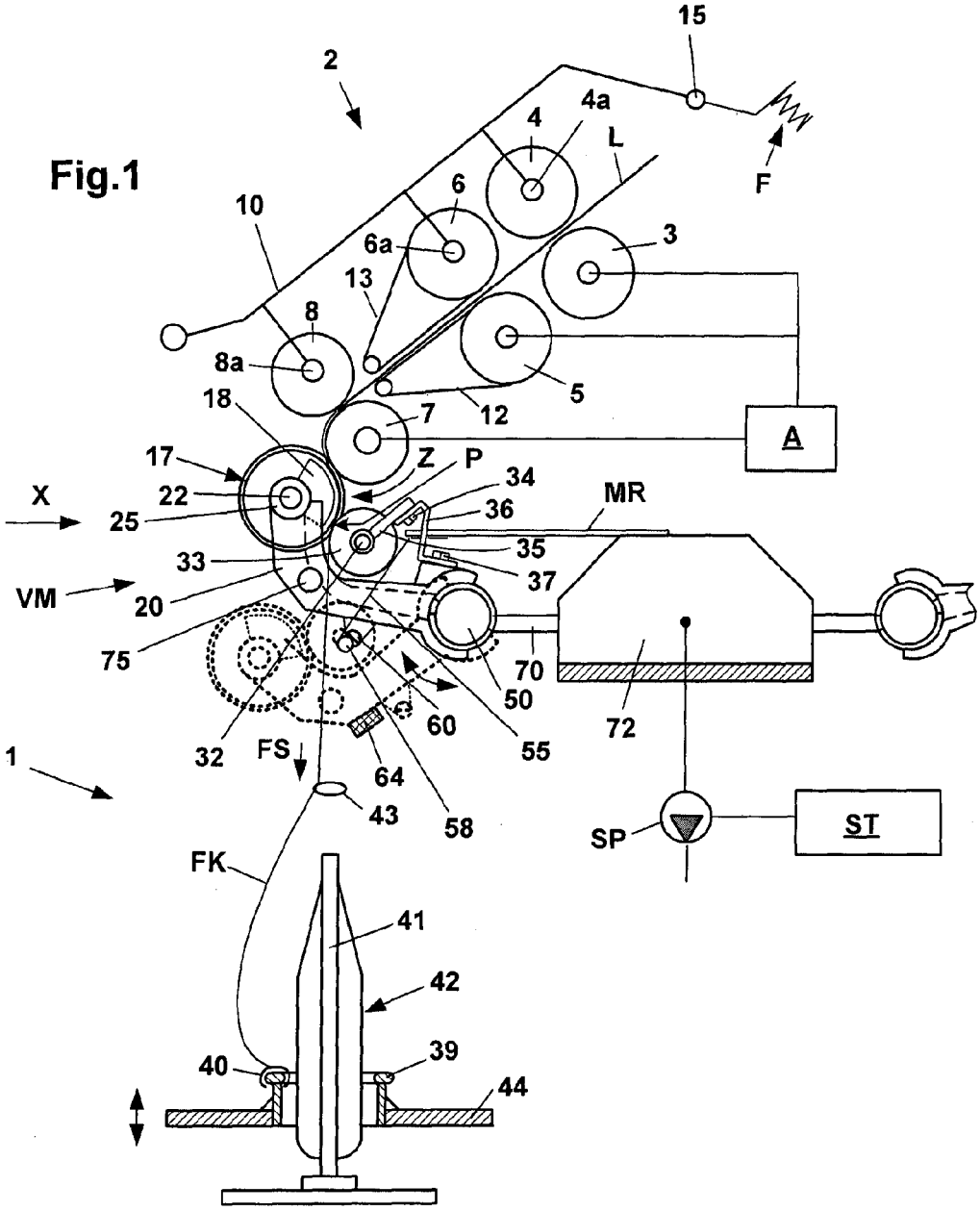
FIG. 1 shows a schematic side view of a spinning station of a ring spinning machine, having a drafting system unit and a compaction device mounted according to the invention.

Reference is now made to particular embodiments of the invention, one or more examples of which are illustrated in the drawings. Each embodiment is provided by way of explanation of the invention, and not as a limitation of the invention. For example, features illustrated as described as part of one embodiment may be used with another embodiment to yield still a further embodiment. It is intended that the present invention include these and other modifications and variations.

FIG. 1 shows a schematic side view of a spinning station 1 of a spinning machine (ring spinning machine), having a drafting system unit 2 that is provided with a pair of feed rollers 3, 4, a pair of middle rollers 5, 6, and a pair of delivery rollers 7, 8. An apron 12, 13 is guided around the middle rollers 5, 6, respectively, each of which is held in its illustrated position around a cage, not shown in greater detail. The upper rollers 4, 6, 8 of the mentioned roller pairs are designed as pressure rollers that are rotatably supported on a pivotably supported pressure arm 10 via the axles 4*a*, 6*a*, 8*a*, respectively, The pressure arm 10 is supported so as to be pivotable about an axle 15, and, as schematically illustrated, is acted on by a spring element F. This spring element may also be an air hose, for example. The rollers 4, 6, 8 are pressed against the bottom rollers 3, 5, and 7, respectively, of the roller pairs via the schematically shown spring loading. The roller pairs 3, 5, 7, as schematically indicated, are connected to a drive A. Individual drives as well as other forms of drives (gearwheels, toothed belts, etc.) may be used. The pressure rollers 4, 6, 8 are driven via the driven bottom rollers 3, 5, 7, respectively, and the apron 13 is driven via the apron 12, by friction. The peripheral speed of the driven roller 5 is slightly greater than the peripheral speed of the driven roller 3, so that the fiber material in the form of a sliver L fed to the drafting system unit 2 is subjected to a break draft between the pair of feed rollers and the pair of middle rollers 5, 6. The main draft of the fiber material L results between the middle roller pair 5, 6 and the pair of delivery rollers 7, 8, the delivery roller 7 having a significantly higher peripheral speed than the middle roller 5.

Figure 2:
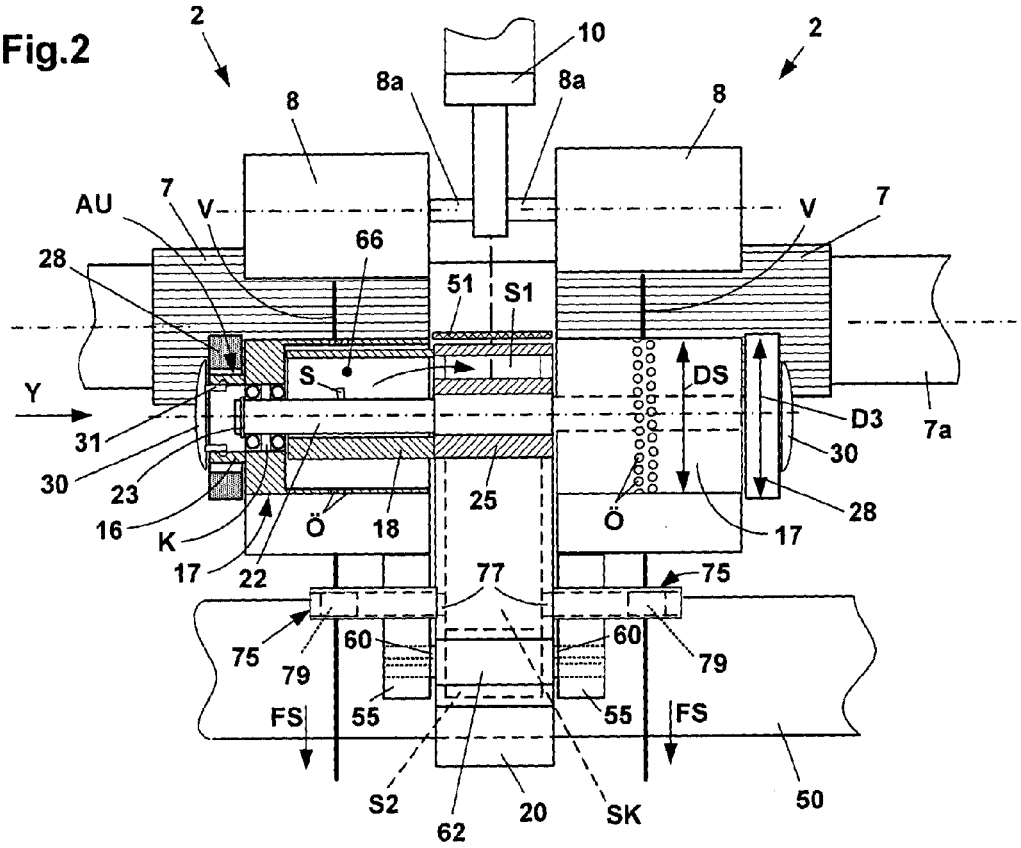
FIG. 2 shows an enlarged partial view X according to FIG. 1 with two adjacently situated drafting system units and compaction devices, rotatably supported on a carrier.

As is apparent from FIG. 2 (view X according to FIG. 1), a pressure arm 10 is associated with two adjacent drafting system units 2 (twin drafting system). Since this involves the same or partially mirror-image elements of the adjacent drafting system units, i.e., compaction devices, the same reference numerals are used for these parts.

The drafted fiber material V delivered by the pair of delivery rollers 7, 8 is deflected downwardly and passes into the area of a suction zone Z of a subsequent suction drum 17. The particular suction drum 17 is provided with perforations or openings Ö (FIG. 2) extending on its periphery. A stationarily supported suction insert 18 is situated in each case inside the rotatably supported suction drum 17. As schematically shown in FIG. 2, the particular suction insert 18 may be held in its installed stationary position by a carrier 20 via holding means, not shown in greater detail. However, an approach would also be possible in which the suction insert 18 is fixedly connected to the carrier. FIG. 2 shows a cover 51, for example, which may have a pivotable design to provide access to the suction drums 17 for cleaning. At the same time, this cover could also be used to fix the suction inserts. A design having dismountable suction inserts, for example, is disclosed in published DE 10 2005 044 967, as well as the design of a suction zone acted on by negative pressure.

As schematically indicated, the particular suction insert 18 has a suction slit S on a partial area of its periphery that extends essentially over the suction zone Z. The particular suction drum 17 is rotatably supported in the area of its outer end on a shaft 22 via bearings K. A retaining ring 23 that prevents displacement of the suction drum during operation is mounted on the shaft 22 for axially fixing the suction drum 17. That is, when the retaining ring 23 is removed it is possible to easily pull the particular suction drum 17 from the shaft 22 in the axial direction. Rapid exchange of the suction drums 17 is thus possible in order to exchange these, if necessary, with other suction drums having a different configuration of the openings Ö in order to convert the compaction element for processing of a different fiber material. The openings Ö may be provided in one row or multiple rows on the periphery of the suction drum 17, or may also be arranged in an offset manner. The particular suction drum may also be removed only for cleaning. The retaining ring may also be, for example, an O-ring made of rubber, or a flexible clamping ring. By applying a small force, it is thus possible to pull the suction drum 17 by its bearing L by hand from the shaft 22 in the axial direction without having to remove the retaining ring 23. This is made possible by elastic yielding of the O-ring or the clamping ring. The suction drum is installed in the reverse direction. Since large axial forces generally do not act on the suction drum 17 during operation, the suction drum is also securely held in its axial position when an elastic retaining ring 23 is used.

The shaft 22 is fastened in a receptacle 25 in the carrier 20. This may be achieved, for example, using fastening means (screws), not shown. In the area of the receptacle 25, the shaft 22 has a slightly larger diameter, while the ends of the shaft 22 extending from this receptacle on both sides have a tapered diameter, and are used for accommodating the particular bearings K. On its end facing away from the carrier 20, the particular suction drum 17 has a ring-shaped projection 16 having an outer diameter D1. A partial area of the inner surface IF of a ring-shaped friction wheel 28 rests on a partial area of the outer periphery of the projection 16, the clearance of this inner surface IF having a diameter D2. In the position shown in FIG. 3 (view Y according to FIG. 2), the particular suction drum 17 is in a working position in which the outer periphery U of the friction wheel 28 rests on the outer periphery U7 of the driven delivery roller 7 via a correspondingly applied pressure load. The closure cap 30 has been omitted in this view to better show the relationships of the gearing stage.

That is, the friction wheel 28 is driven via friction from the roller 7. Likewise, via friction, the friction wheel 28 transmits the drive to the ring-shaped projection 16 of the suction drum 17. This occurs at the location where the inner surface IF having inner diameter D2 of the friction wheel 28, and the outer periphery AU of the projection 16 having outer diameter D1, contact or rest against one another. The friction wheel 28 may be made of an elastic solid material such as rubber.

Figure 3:
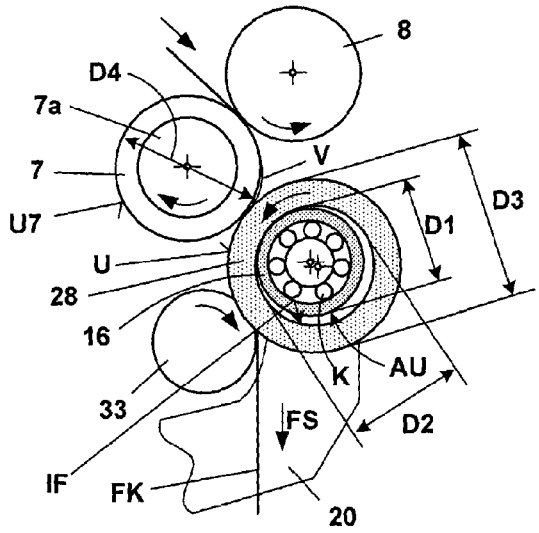
FIG. 3 shows a partial view Y according to FIG. 2.

In the working position shown in FIG. 3, the outer periphery of the suction drum 17 having diameter DS (FIG. 2) is situated at a small distance from the outer periphery of the delivery roller 7. This is ensured when the following dimensional relationships are present:

$$\frac{DS}{2} < \frac{D1}{2} + \left(\frac{D3}{2} - \frac{D2}{2}\right).$$

The particular peripheral speed, i.e., the rotational speed, of the suction drum 17 results from the selected diameter ratios D1 through D4. That is, the gear ratio between the driven delivery roller 7 and the particular suction drum 17 results from the relationship $$\frac{D4}{D3} \times \frac{D2}{D1}.$$

Depending on the selection of the diameter ratios, it is thus possible to select the peripheral speed of the particular suction drum 17 to be greater or smaller than the peripheral speed of the driven delivery roller 7. In some cases, it is advantageous to select the gear ratio in such a way that the peripheral speed of the subsequent suction drum 17 is slightly less than the peripheral speed of the delivery roller 7. It is thus possible, for example, to compensate for lateral displacement of the fiber material in the area of the suction zone Z above a correspondingly designed suction slit S. The suction zone Z, viewed in the peripheral direction of the suction roller 17, extends approximately between the area where the friction wheel rests on the delivery roller 7 and the nip line P between a nip roller 33 and the suction drum 17.

As is apparent from FIG. 2, a closure cap 30 is fastened in the area of the ring-shaped projection 16 which with its outer diameter protrudes beyond the clearance D2 of the friction wheel 28. The closure cap 30 is provided with a ring-shaped projection 31 that protrudes into the clearance of the ring-shaped projection 16 of the suction drum 17. The outer dimensions of the ring-shaped projection 31 are selected in such a way that, in the position shown in FIG. 2, they exert a clamping effect within the clearance of the projection 16. As schematically illustrated, the ring-shaped projection 31 may be provided with additional outwardly protruding cams, which for fixing the closure cap 31, engage in circumferential indentations within the clearance of the projection 16. Numerous designs are possible for fixing the closure cap 30 in the position shown in FIG. 2. As a result of the closure cap 30, the friction wheel 28 is held in position on the shaft 22 in the axial direction.

As is apparent from FIG. 2, two suction drums 17 of adjacent spinning stations are rotatably supported on the shaft 22 fastened to the carrier 20. The suction drums 17 together with a respective friction wheel 28 are situated in a mirror image with respect to the carrier 20.

Following the suction zone Z, for each of the suction drums 17, a nip roller 33 is provided that rests on the respective suction drum 17 via a pressure load and which with this suction drum forms a nip line P. The particular nip roller 33 is rotatably supported on an axle 32 that is fastened to a bearing element 35 connected to a spring element 36 via screws 34 (or some other fastening elements). The spring element 36, via which a contact force of the nip roller 33 is generated in the direction of the suction drum 17, is fastened to the carrier 20 via the schematically illustrated screws 37 (or some other fastening elements). This fastening point may be designed in such a way (for example, by means of oblong holes in the spring element 36) that the contact force of the nip roller 33 on the suction drum 17 is settable.

At the same time, the nip line P forms a so-called "twist stop" from which the fiber material is fed, in the conveying direction FS in the form of a compressed yarn FK with imparting of twist, to a schematically shown ring spinning device. The ring spinning device is provided with a ring 39 and a traveler 40, the yarn being wound onto a bobbin 41 to form a spool 42 (cop). A thread guide 43 is situated between the nip line P and the traveler 40. The ring 39 is fastened to a ring frame 44 which undergoes an up-and-down motion during the spinning process.

Figure 4:
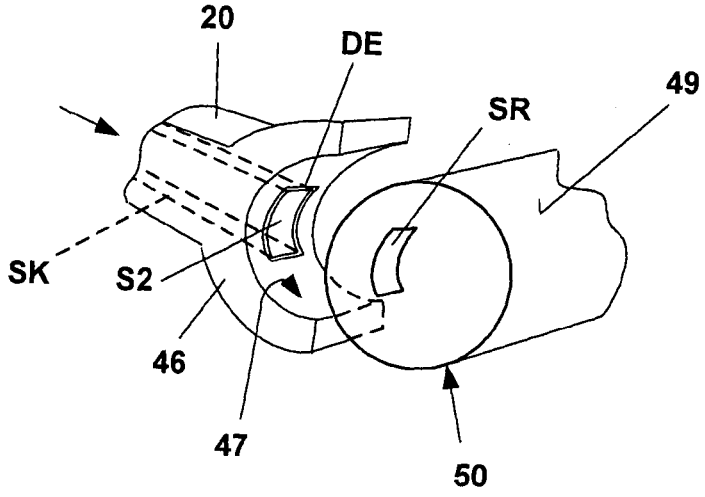
FIG. 4 shows an enlarged perspective partial view, according to FIG. 1, of the fastening point of the carrier.
Figure 5:
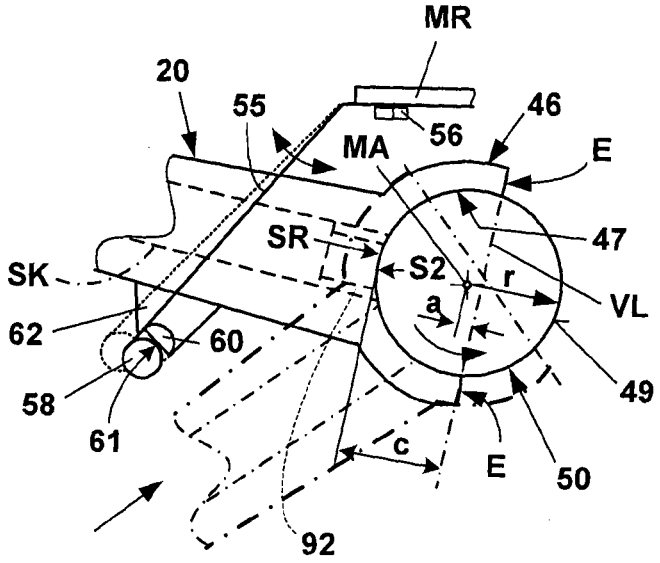
FIG. 5 shows an enlarged partial view of the carrier according to FIG. 1, with a locking device for the carrier.

On its end opposite from the spinning machine, the carrier 20 is provided with a U-shaped or fork-shaped end piece 46 (FIG. 4), which in the mounted position shown in FIG. 1 and FIG. 5, rests with its inner surface 47 on a partial area of the outer periphery 49 of a suction tube 50. As is apparent in particular from FIG. 5, the fork-shaped end piece 46 is designed in such a way that the connecting line VL between the ends E of the end piece extends at a distance a from the center axis MA of the suction tube 50. That is, in the installed position of the carrier 20 shown in FIG. 1 and FIG. 5, the distance c between the connecting line VL and a plane parallel thereto that is tangential with respect to the inner surface 47 is greater than the radius r of the suction tube 50 by the dimension a. It is thus ensured that a clamping effect results between the inner surface 47 of the end piece 46 and the outer periphery 49 of the suction tube 50, and the carrier is held in this installed position. For the installation in this position, the carrier 20 is pushed onto the suction tube 50 in the position shown by a dashed line by means of a small pressure force shown in the direction of the arrow. The material of the carrier 20, at least the material of the end piece 46, is selected in such a way that in the attachment operation on the suction tube 50 the legs of the end piece 46 may elastically yield, whereby after the attachment operation the inner surface 47 of the end piece 46 rests completely on the outer periphery 49 of the suction tube 50. The contact pressure effect between the end piece 46 and the suction tube 50 is selected in such a way that it is possible for the carrier 20 to pivot about the center axis MA of the suction tube 50. To hold the carrier 20 and the suction drums 17 rotatably supported thereon together with the nip rollers 33 in a working position in which the respective friction wheels 28 are in drive connection with the delivery rollers 7 via a contact pressure force, a spring rod 55 is provided on each side of the carrier, and is fastened to the machine frame MR of the spinning machine via fastening elements 56 (screws, for example). A circular rod 58 is fastened to the free end of the particular spring rod 55. As is apparent in particular from FIG. 5, in this position a flat surface 61 of a semicircular rod 60 rests on the periphery of the circular rod 58. The rod 60 is fixedly connected to the carrier 20 via a web 62. As schematically shown in FIG. 2, a semicircular rod 60 extends on each side of the carrier 20, and in the working position rests on the rod 58 and in this position assumes a locking position. This locking position may be released only by applying an appropriate force. This is the case when the compaction module VM must be swiveled into a lower position shown by dashed lines (FIG. 1). This swiveling is necessary when access to the drafting system output must be gained for maintenance operations, or when the compaction module itself must be serviced. To hold the compaction module VM in the lower position shown by dashed lines, a stop 64 is provided that is mounted on the machine frame. In this position, the compaction module may also be removed by manually pulling the suction tube 50 from the spinning machine. In the described swiveling operation of the compaction module VM into a lower position, the particular spring rod 55 yields in the position indicated by dotted lines, so that the rod 60 may slide past the rod 58. As soon as the rod 60 has passed the rod 58, the spring rod 55 resumes its original position due to the spring effect. In the upward swiveling of the carrier 20 about the center axis MA, the semicircular surface of the rod 60 meets the peripheral surface of the rod 58, and upon further swiveling pushes the rod 58 into the position indicated by dotted lines. As soon as the flat surface 61 of the rod 60 is located above the rod 58, the rod is moved back into the original position due to the elastic force of the spring rod 55 and resumes its locked position with the rod 60, as shown in FIG. 5.

Extending within the carrier 20 is a suction channel SK that has an opening S2 on the inner surface 47 of the end piece 46, and a further opening S1 situated in the area of the receptacle 25, which is connected to the interior 66 of the particular suction insert 18. In the working position, the opening S2 is situated opposite from an opening SR in the suction tube 50, as the result of which the interior of the suction tube 50 is connected to the suction channel SK. To seal off the connection between the opening S2 and the opening SR from the outside, a sealing element DE is provided in the area of the inner surface 47 of the end piece 46 that is placed around the opening S2. The sealing element DE is designed or mounted in such a way that it comes into contact with the outer periphery of the tube 50 during installation of the carrier 20, and seals the connecting point between the openings S2 and SR with respect to the surroundings. As schematically indicated, an exchangeable insert 92 may be provided in the area of the opening S2. It is thus possible, depending on the clearance of the cross-sectional surface of the insert 92, to influence the pressure conditions in the compaction module. That is, depending on the distance of the installation position of the compaction module on the spinning machine from a stationary negative pressure source, an appropriate insert 92 is used to obtain the same negative pressure conditions at all installed compaction modules.

As is apparent from FIG. 1, the suction tube 50 is connected to a central main channel 72 via one or more connecting channels 70. This channel 72 is connected to a negative pressure source SP which may be controlled via a control unit ST. Further connections (not shown) to the suction channel 72 may also be provided, which are connected to appropriate suction stations for keeping the spinning machine clean.

In the event of a thread break between the nip line P and the spool 42, to be able to suction yarn FK that is further delivered via the nip point P, a suction tube 75 is fastened to each side of the carrier 20, whose respective opening 77 facing the carrier 20 is connected to the channel SK. The outwardly protruding end, viewed from the carrier, of the particular suction tube 75 is closed. An opening 79 that points in the direction of the downwardly pulled yarn FK is provided on a partial area of the periphery of the particular suction tube. That is, if a thread break occurs, via the suction channel SK, the end of the further delivered thread or yarn is fed to the suction tube 50 via the particular suction tube 75 under the action of the negative pressure generated via the negative pressure source SP, and the suction tube delivers the thread or yarn via the channel(s) 70 to the main channel 72 for further supply to a collection station.

As a result of the proposed design of a compaction module, it is possible to integrate or add this type of compaction unit, also as a retrofit to conventional spinning machines, without having to install additional specialized drive means (for example, additional driven longitudinal shafts). The drive of the suction drum, as well as the drive of the nip roller cooperating with the suction drum, is easily removed from the driven delivery roller, already present, of the drafting system unit 2 via the friction wheel gearing that is integrated on the compaction module or the shown drive via a gearwheel provided with additional internal toothing. That is, no additional longitudinal shafts must be mounted on the spinning machine in order to integrate a device for compacting the sliver on the spinning machine. Each compaction module VM is a separate closed unit, and in the proposed version is provided for two adjacent spinning stations in each case.

Figure 6:
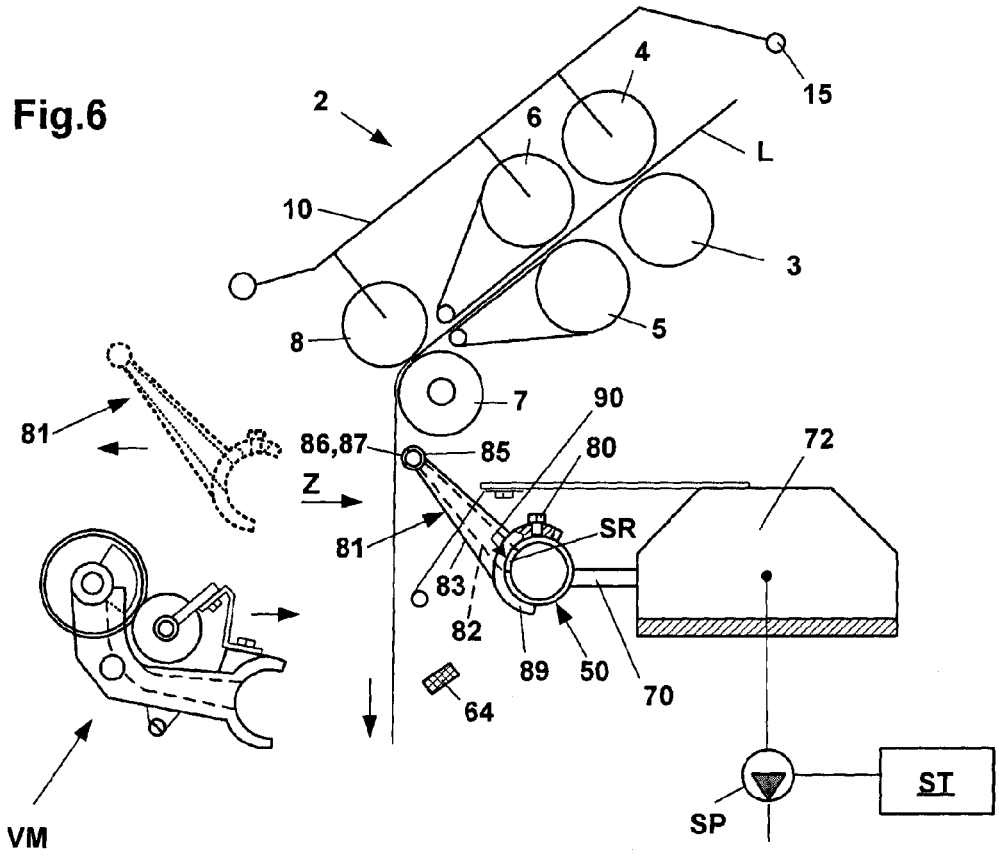
FIG. 6 shows a schematic partial view according to FIG. 1, without a compaction device.
Figure 7:
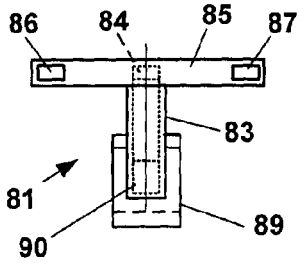
FIG. 7 shows a view Z of the thread suction tube according to FIG. 6.

As is apparent from the schematic illustration in FIG. 6, a thread suction tube 81 on a conventional spinning machine (without a compaction unit) may be fastened to the suction tube 50 via fastening means 80 (screws, for example) and exchanged with a compaction module VM. The channel 82 inside the suction tube 81 likewise opens into the opening SR in the suction tube 50. As is apparent, for example, from the view Z (according to FIG. 6) in FIG. 7, the thread suction tube 81 is provided with a transverse tube 85 that is connected to a central tube piece 83. To be able to carry out the thread suction at two adjacent spinning stations, openings 86, 87 that point in the direction of the yarn, which in each case is pulled downwardly, are provided in each case in the area of the two ends of the transverse tube 85. A U-shaped end piece 89 is fastened to the end of the tube piece 83, and essentially corresponds to the end piece 46 that is mounted on the compaction module VM. The opening 90 in the tube piece 83, which ends in the area of the end piece 89, in the installed position is opposite from the opening SR in the suction tube 50. For sealing off this connecting point, sealing elements may also be provided as described for the compaction module. The other opening 84 is connected to the interior of the transverse tube 85. These two units may thus be easily and quickly exchanged with one another. That is, conversion or retrofitting of this type of spinning machine to a design having a compaction unit is possible within a relatively short time period. This ensures universal use of a spinning machine by the spinning mill owner.

Using appropriate color coding of the spools, on a single spinning machine it is possible to equip partial regions with compaction devices, while at the other regions, yarns are produced without compacting. That is, by use of this device, a spinning machine may be used in an even more universal manner.

Modifications and variations can be made to the embodiments illustrated or described herein without departing from the scope and spirit of the invention as set forth in the appended claims.

The invention claimed is:

1. A device for compacting a sliver on a spinning machine, wherein the sliver is delivered by a pair of delivery rollers of a drafting system of the spinning machine, the device comprising:

a driven, revolving compaction element having openings and a suction zone with a suctioned guide surface;

a rotatably supported nip roller defining a nip line with the compaction element downstream of the suction zone;

a shared support configured for detachable fastening to the spinning machine, the compaction element and the nip roller supported on the shared support;

the compaction element having a drive element configured to form a drive connection with a bottom roller of the pair of delivery rollers via a weighting device, wherein the compaction element is movable between an idle position and an operating position; and the shared support having a suction channel with a first end connected to the compaction element to deliver suction air to the compaction element, the suction channel having a second end disposed at a location on said shared support where the shared support connects to the spinning machine in an installed position of the device on the spinning machine.

2. The device as in claim 1, wherein the shared support comprises a contact surface that rests against an element of the spinning machine in the installed position of the device on the spinning machine, the second end of the suction channel defined at the contact surface.

3. The device as in claim 2, wherein the element of the spinning machine is a channel connected to a negative pressure source, the contact surface in communication with the channel via an opening in the channel in the installed position of the device on the spinning machine.

4. The device as in claim 3, wherein the second end of the suction channel comprises an elastic sealing element that seals against the channel of the spinning machine around the opening in the channel in the installed position of the device on the spinning machine.

5. The device as in claim 4, wherein the channel of the spinning machine has a circular cross-section, the shared support comprising a U-shaped end piece that partially encloses the channel in the installed position of the device on the spinning machine.

6. The device as in claim 1, wherein the compaction element further comprises a gearing stage operably configured with the drive element.

7. The device as in claim 6, wherein the drive element comprises a friction wheel that frictionally engages against a bottom roller of the delivery roller pair in the installed position of the device on the spinning machine via the weighting device.

8. The device as in claim 7, wherein the compaction element comprises a revolving suction drum.

9. The device as in claim 8, wherein the suction drum is rotatably supported on a shaft via bearing elements and is fixed on the shaft in the axial direction via a securing device, the shaft fastened to the shared support.

10. The device as in claim 9, wherein the friction wheel comprises a symmetrical ring having a circular inner surface that rests on a partial area of a peripheral surface of a circular projection connected in an axially parallel manner to the suction drum, wherein the circular inner surface of the friction wheel has a diameter that is greater than an outer diameter of the projection.

11. The device as in claim 1, wherein the nip roller is disposed beneath the compaction element after the suction zone.

12. The device as in claim 1, wherein the suction channel is connected to a suction tube of the spinning machine in the installed position of the device on the spinning machine for thread suction.

13. The device as in claim 1, wherein the nip roller is rotatably fastened to the shared support via a spring element that generates a clamping force of the nip roller against the compaction element along the nip line.

14. The device as in claim 1, wherein the shared support is configured to be pivotably fastened to the spinning machine transversely relative to a rotational axis of the pair of delivery rollers, the shared support comprising swivel elements that interact with holding means on the spinning machine, the swivel elements also serving to limit swivel motion of the support.

15. The device as in claim 14, wherein the holding means on the spinning machine are spring elements, the swivel elements on the shared support comprising locking bars, wherein in a locked position of the locking bars, the drive element is held in frictional locking connection with one of the rollers of the pair of delivery rollers.

16. The device as in claim 1, further comprising exchangeable inserts provided in the area of the second end of the suction channel of the shared support.

17. The device as in claim 1, wherein the drafting system of the spinning machine is a twin drafting system having two adjacently situated drafting systems on a shared weighting arm, the device comprising a compaction element and respective nip roller for each respective drafting system, wherein the suction channel is a shared channel for the compaction elements.

18. A spinning machine for processing a sliver, comprising:

a drafting system having a pair of delivery rollers;

a device for compacting the sliver delivered by the delivery rollers, the compacting device further comprising:

a driven, revolving compaction element having openings and a suction zone with a suctioned guide surface;

a rotatably supported nip roller defining a nip line with the compaction element downstream of the suction zone;

a shared support detachably fastened to the spinning machine, the compaction element and the nip roller supported on the shared support;

the compaction element having a drive element in a drive connection with a bottom roller of the pair of delivery rollers via a weighting device, wherein the compaction element is movable between an idle position and an operating position; and the shared support having a suction channel with a first end connected to the compaction element to deliver suction air to the compaction element, the suction channel having a second end disposed at a location on said shared support where the shared support is connected to the spinning machine.

* * * * *